US007980192B2

(12) United States Patent
Flynn

(10) Patent No.: US 7,980,192 B2
(45) Date of Patent: Jul. 19, 2011

(54) CHAIR MOUNT ASSEMBLY AND RELATED KIT FOR RETROFITTING A BENCH-STYLE BOAT SEAT OR THWART

(76) Inventor: James Flynn, Auburn, WA (US)

( * ) Notice: Subject to any disclaimer, the term of this patent is extended or adjusted under 35 U.S.C. 154(b) by 578 days.

(21) Appl. No.: 12/116,667

(22) Filed: May 7, 2008

(65) Prior Publication Data

US 2009/0277371 A1 Nov. 12, 2009

(51) Int. Cl.
*B63B 17/00* (2006.01)
*B63B 29/04* (2006.01)
*A47C 1/16* (2006.01)

(52) U.S. Cl. ..... 114/363; 297/250.1; 297/252

(58) Field of Classification Search ..... 114/343, 114/363; 297/138, 143, 250.1, 252, 256.16, 297/344.1, 344.11; 248/228.3, 230.3, 230.41, 248/316.4

See application file for complete search history.

(56) References Cited

U.S. PATENT DOCUMENTS

| | | | | |
|---|---|---|---|---|
| 2,480,402 | A | 8/1949 | Elston | |
| 2,843,348 | A | 7/1958 | Samuels | |
| 3,591,112 | A | 7/1971 | Garmhausen | |
| 3,718,365 | A | 2/1973 | Gibson | |
| 3,789,444 | A | 2/1974 | McCord | |
| 3,821,825 | A | 7/1974 | Bailey | |
| 4,398,766 | A | 8/1983 | Everett | |
| 4,802,708 | A * | 2/1989 | Vos et al. | 297/252 |
| 2007/0216209 | A1 | 9/2007 | Kuenzel et al. | |

* cited by examiner

*Primary Examiner* — Ajay Vasudeva
(74) *Attorney, Agent, or Firm* — Thomas E. Loop; Graybeal Jackson LLP

(57) ABSTRACT

The invention disclosed herein is directed to a chair mount assembly and related kit for retrofitting a bench-style boat seat or thwart. The inventive chair mount assembly kit includes (1) first and second rails; (2) first and second sliders having respective first and second end portions, wherein the first end portion of the first slider section includes a first rail connector and the first end portion of the second slider section includes a second rail connector, and wherein the first rail connector is matingly and slidably engagable to the first rail and the second rail connector is matingly and slidably engagable to the second rail; and (3) an interconnecting base plate adjustably connectable to the second end portions of the first and second sliders and movable together with the first and second sliders back and forth along the first and second rails.

8 Claims, 15 Drawing Sheets

CHAIR MOUNT ASSEMBLY AND RELATED KIT FOR RETROFITTING A BENCH-STYLE BOAT SEAT OR THWART

TECHNICAL FIELD

The present invention relates generally to chairs and seats and, more particularly, to chair and seat assemblies and related kits having detachable interfitting parts or components, and that are configured to retrofit a bench-style boat seat or thwart.

BACKGROUND OF THE INVENTION

Pleasure boats such as high-end fishing and bass boats are typically equipped with one or more padded swivel seats. Each swivel seat is typically mounted in a recessed hole or base in the raised deck portion of the boat, and provides for a more comfortable vantage point for the angler who wants better viewing. Rowboats and dinghies, however, are generally not equipped with plush swivel seats; rather, these types of boats are typically equipped with only one or more traverse bench-style seat (also commonly referred to as a thwart). As is known in the art, a typical thwart consists of a flat wooden or metallic plank (relatively uncomfortable) extending transversely across the boat. Thus, it would be desirable to provide a way to retrofit a bench-style boat seat or thwart with an adjustable and more comfortable swivel seat.

A review of the prior art and, in particular, the various chair and seat assemblies identified under Class 297, Chairs and Seats, of the U.S. Patent Classification system reveals very few devices for retrofitting a bench-style boat seat or thwart into a more comfortable and luxurious adjustable swivel seat arrangement. A number of boat seat attachments, however, are known in the art. Such attachments generally vary as to the means for releasably securing the seat base to the thwart of the boat. For example, U.S. Pat. No. 2,843,348 to Samuels discloses a detachable mounting for boat seats wherein a plurality of thwart-engaging cams are rotatably mounted on opposing ends of a pair of telescoping inner and outer members. A crank is journalled for rotation in the outer end of the outer member and is in unitary assembly with a rod disposed therein. The rod has a screw-threaded inner end disposed in a complementary screw-threaded recess in the inner end of the inner member. Rotation of the crank rotates the rod and, therefore, causes the cams to move together and grip the boat thwart. Similarly, U.S. Pat. No. 3,591,112 to Garmhausen discloses a boat seat clamp having a horizontal bar which can be adjusted lengthwise. A clamp member is slidably mounted on one end of the bar and locked to the bar by cam action under clamping pressure applied by an operator so as to frictionally engage the thwarts.

U.S. Pat. No. 3,718,365 to Gibson discloses a seat attachment for boats which includes a rectangular, tubular main frame having clamp means for detachably securing the frame to the sides of the boat. A sub-frame carrying a seat is engaged with opposite sides of the tubular main frame to permit sliding adjustment of the sub-frame longitudinally of the main frame. U.S. Pat. No. 3,789,444 to McCord discloses a boat seat holder assembly including a pair of bracket plates interconnected by a swivel plate seat mounting assembly. The forward plate has a substantially monoplanar main plate portion with a turned-over flange at the forward edge thereof. The rear bracket plate has a substantially monoplanar main portion with a first flange portion bent from and extending at a right angle to the main plate portion. The front and rear bracket plates cooperate to frictionally engage the permanent seat of a boat.

U.S. Pat. No. 3,821,825 to Bailey discloses a removable boat seat attachment having a seat rotatably mounted on a base member. The base member has seat board engaging members which cooperate with an adjustable clamp having seat board engaging portions such that the engaging member and the clamp engage opposite edges of the seat board for securing the base member thereto. Quick release locking-type fasteners have portions secured to the base member and the clamp for urging and normally maintaining the seat board engaging portions in clamping engagement and removably securing the boat seat attachment thereto.

The boat seat constructions of the prior art suffer from several deficiencies. Many of such constructions are not adaptable to bench and thwart structures of different sizes. Others require time-consuming effort to attach the seat to the bench or thwart and release it therefrom. Those constructions which avoid these problems suffer from expensive and complicated mounting structures. Thus, there is still a need in the art for new and improved chair mount assemblies and related kits for retrofitting a bench-style boat seat or thwart. The present invention fulfills these needs and provides for further related advantages.

SUMMARY OF THE INVENTION

In brief, the present invention in one embodiment is directed to a chair mount assembly configured to retrofit a bench-style boat seat or thwart. In this embodiment, the inventive chair mount assembly comprises (1) first and second rails positioned parallel and along the lengthwise direction of respective first and second downwardly extending sidewalls of the bench-style boat seat or thwart; (2) first and second sliders positioned across from each other and substantially above a top surface of the bench, each slider having respective first and second end portions, wherein the second end portions confront each other so as to define a gap section above the top surface of the bench, and wherein the first end portion of the first slider section includes a first rail connector and the first end portion of the second slider section includes a second rail connector, and wherein the first rail connector is matingly coupled and slidably engaged to the first rail and the second rail connector is matingly coupled and slidably engaged to the second rail; and (3) an interconnecting base plate positioned in the gap section between the first and second sliders, wherein the interconnecting base plate is adjustably connected to the second end portions of the first and second sliders and movable together with the first and second sliders back and forth along the first and second rails.

In another embodiment, the present invention is directed to a chair mount assembly kit for retrofitting a bench-style boat seat or thwart. In this embodiment, the inventive chair mount assembly kit comprises (1) first and second rails for placement along the lengthwise direction of respective first and second downwardly extending sidewalls of the bench-style boat seat or thwart; (2) first and second sliders having respective first and second end portions, wherein the first end portion of the first slider section includes a first rail connector and the first end portion of the second slider section includes a second rail connector, and wherein the first rail connector is matingly and slidably engagable to the first rail and the second rail connector is matingly and slidably engagable to the second rail; and (3) an interconnecting base plate that is adjustably connectable to the second end portions of the first and second sliders and movable together with the first and second sliders back and forth along the first and second rails.

BRIEF DESCRIPTION OF THE DRAWINGS

The drawings are intended to be illustrative and symbolic representations of certain exemplary embodiments of the present invention and as such they are not necessarily drawn to scale. In addition, it is to be expressly understood that the relative dimensions and distances depicted in the drawings (and described in the "Detailed Description of the Invention" section) are exemplary and may be varied in numerous ways. Finally, like reference numerals have been used to designate like features throughout the several views of the drawings.

DETAILED DESCRIPTION OF THE INVENTION

Figure 1A:
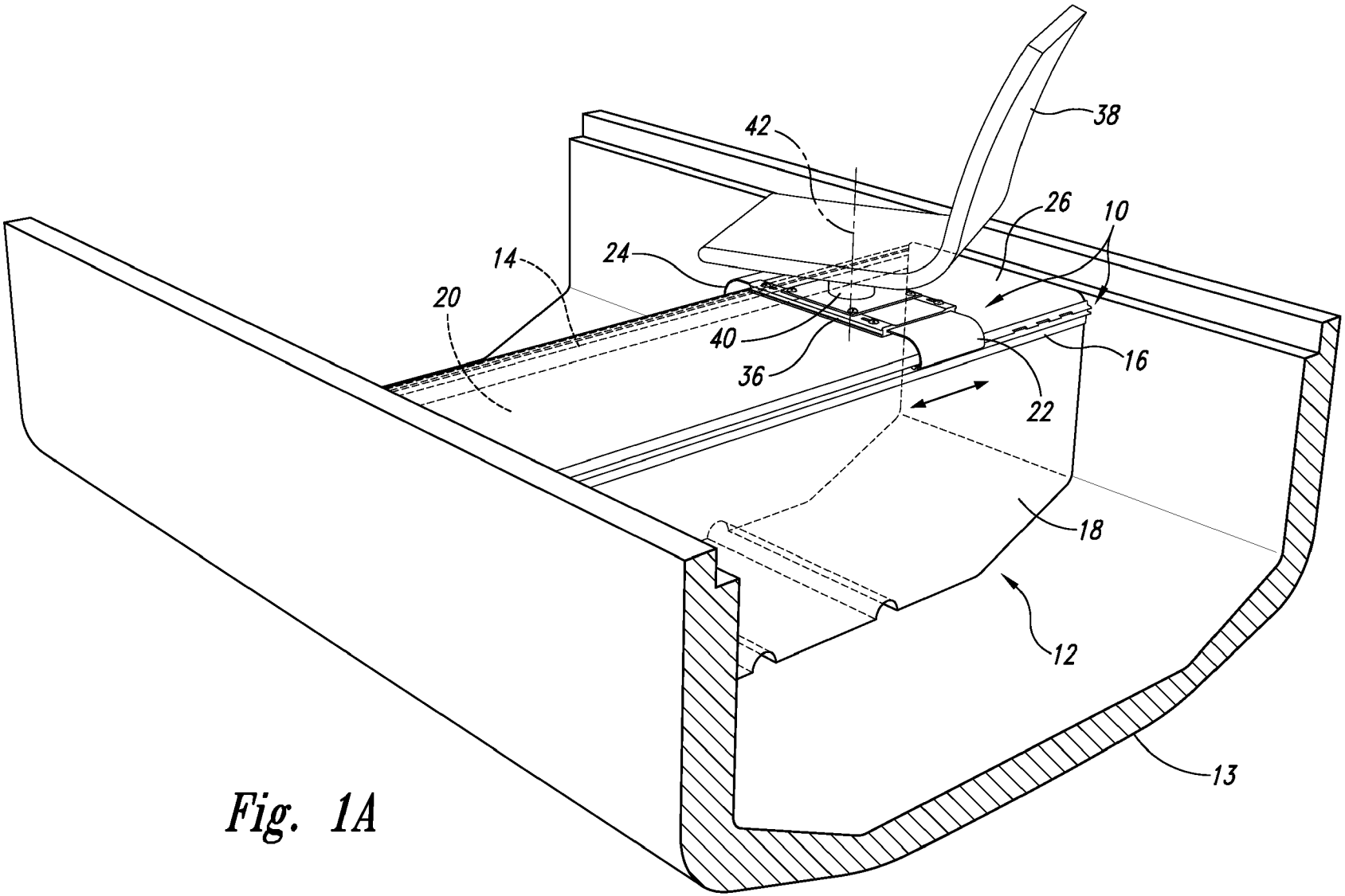
FIG. 1A is a side perspective backside view of a chair mount assembly (in combination with a swivel chair) configured to retrofit a bench-style boat seat or thwart in accordance with an embodiment of the present invention, wherein first and second sliders are interconnected by a base plate and are slidably engaged with first and second rails, and wherein the first and second rails are positioned along respective first and second downwardly extending sidewalls of the bench-style boat seat or thwart.

Referring now to the drawings wherein like reference numerals designate identical or corresponding elements, and more particularly to FIGS. 1-5C, the present invention in one embodiment is directed to a chair mount assembly 10 configured to retrofit a bench-style boat seat or thwart 12. As shown, the inventive chair mount assembly 12 comprises first and second rails 14, 16 (extruded from aluminum, for example, and preferable having the same size and shape) positioned parallel and along the lengthwise direction of respective first and second downwardly extending sidewalls 20, 18 of the bench-style boat seat or thwart 12 (wherein the boat 13 is shown in partial cross-section in FIG. 1A). First and second sliders 24, 22 are positioned across from each other and substantially above a top surface 26 of the bench-style boat seat or thwart 12. Each slider 24, 22 (machined from aluminum, for example) has respective first and second end portions 28', 28, 30', 30. The second end portions 30', 30 confront each other so as to define a gap section 31 above the top surface 26 of the bench-style boat seat or thwart 12. In addition, the first end portion 28' of the first slider 24 includes a first rail connector 34 and the first end portion 28 of the second slider 22 includes a second rail connector 32. As best shown in FIGS. 1A-C, the first rail connector 34 may be matingly coupled and slidably engaged to the first rail 14 and the second rail connector 34 may be matingly coupled and slidably engaged to the second rail 16. In other words and in this configuration, the first and second sliders 24, 22 are readily connectable and detachable from the first and second rails 14, 16 by way of the first and second rail connectors 34, 32.

In another aspect of the present invention, the first and second sliders 24, 22 (preferable having the same size and shape and as best shown in FIGS. 4A-D) each include a downwardly curved first end portion 28', 28, wherein the downwardly curved first end portion 28' of the first slider 24 includes the first rail connector 34 and the downwardly curved first end portion 28 of the second slider 22 includes the second rail connector 32. The first and second rail connectors 34, 32 preferably have cross-sectional profiles that define partial circles and define a plurality of couplings 35.

As best shown in FIGS. 2A-E and 3A-E and in one embodiment, the first and second elongated rails 14, 16 each define an elongated raceway groove 44, 44' positioned on an elongated flat strip 46, 46'. Each elongated raceway groove 44, 44' is parallel to the lengthwise direction of the bench-style boat seat or thwart 12 and includes elongated lower and upper sidewalls 48, 48', 49, 49'. The lower and upper sidewalls 48, 48', 49, 49' each define respective elongated openings that preferably have cross-sectional profiles that define partial circles. In addition, a plurality of notches 54 are positioned along the lower sidewall 48 of the raceway groove 44 associated with the first rail 14, whereas a plurality of similar notches 54' are positioned along the upper sidewall 49' of the raceway groove 44' associated with the second rail 16. In this configuration, the plurality of couplings 35 are complementary and able to pass through the respective plurality of notches 54, 54' associated with the first and second rails 14, 16.

As best shown in FIGS. 6A-E and 7A-E and in an alternative embodiment, the first and second elongated rails 14', 16' each define an elongated raceway groove 44", 44'" positioned on an elongated "L-shaped" strip 46", 46'".

Figure 1B:
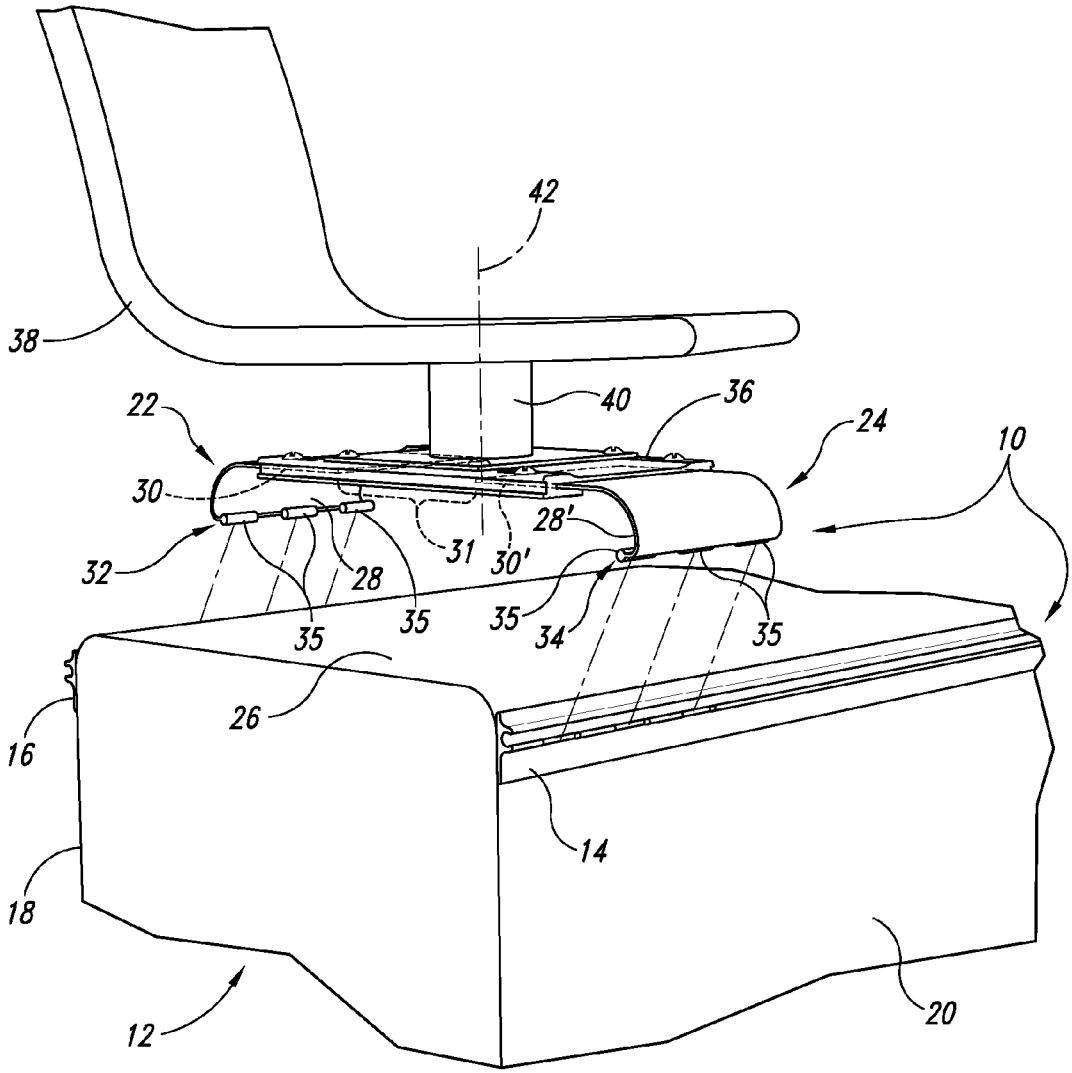
FIG. 1B is a side perspective frontside view of the chair mount assembly shown in FIG. 1A (in combination with a swivel chair) configured to retrofit a bench-style boat seat or thwart, but where the first and second sliders (interconnected by a base plate) are disengaged from the first and second rails.
Figure 1C:
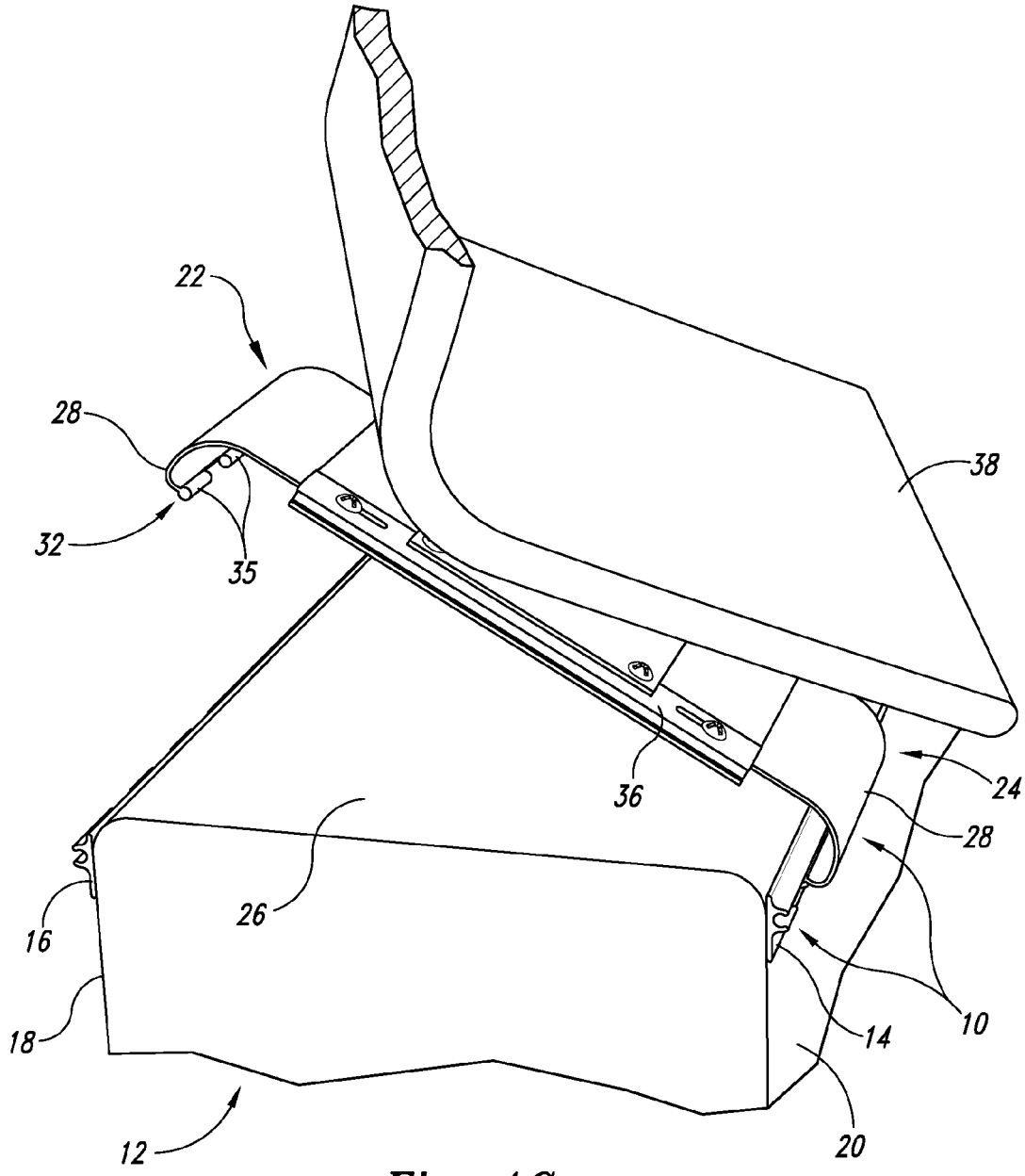
FIG. 1C is a side perspective view of the chair mount assembly shown in FIGS. 1A-B, but where the first and second sliders (interconnected by a base plate) are partially disengaged from the first and second rails (meaning the first slider is engaged with the first rail, while the second slider is disengaged from the second rail).
Figure 2A:
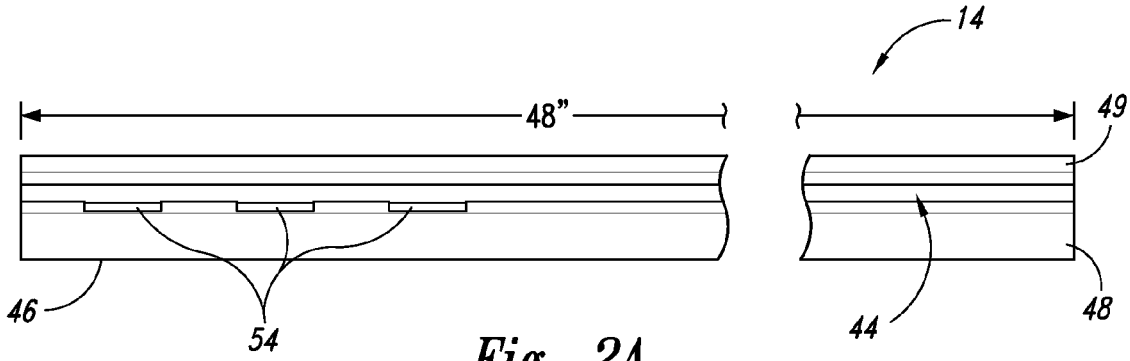
FIG. 2A is a side view of a first notched rail in accordance with an embodiment of the present invention.
Figure 2B:
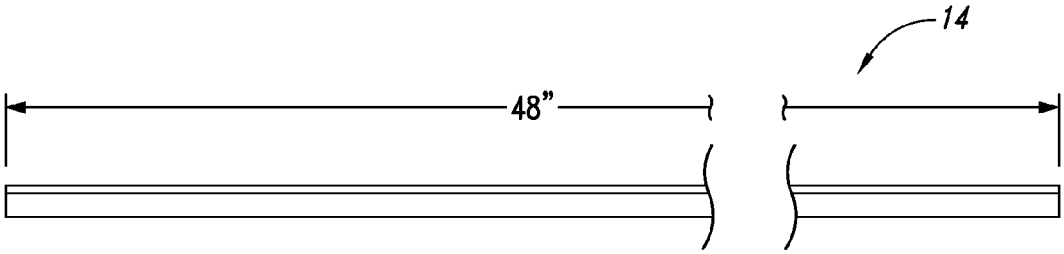
FIG. 2B is a top view of the first notched rail shown in FIG. 2A.
Figure 2C:
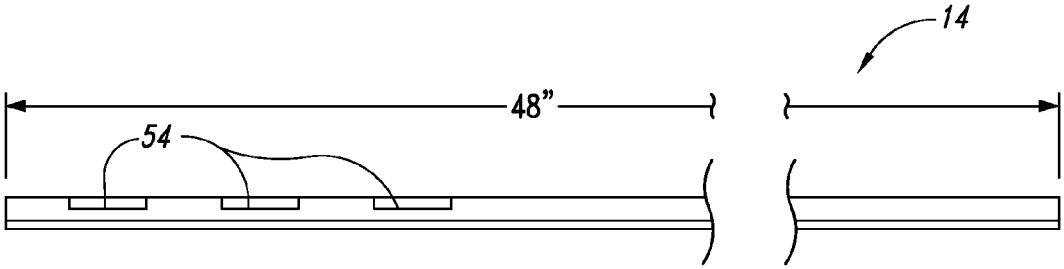
FIG. 2C is a bottom view of the first notched rail shown in FIGS. 2A-B.
Figure 2D:
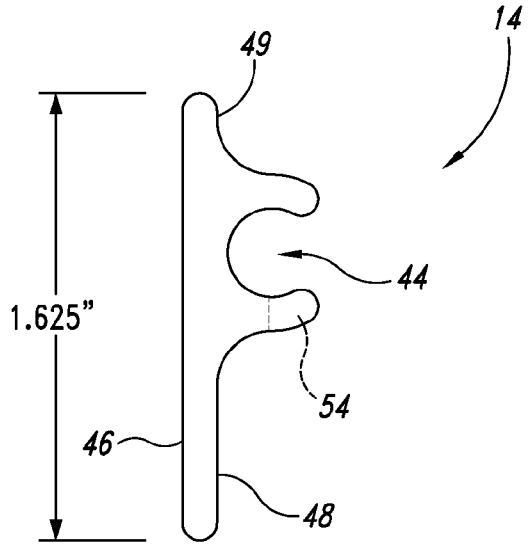
FIG. 2D is an end view of the first notched rail shown in FIGS. 2A-C.
Figure 2E:
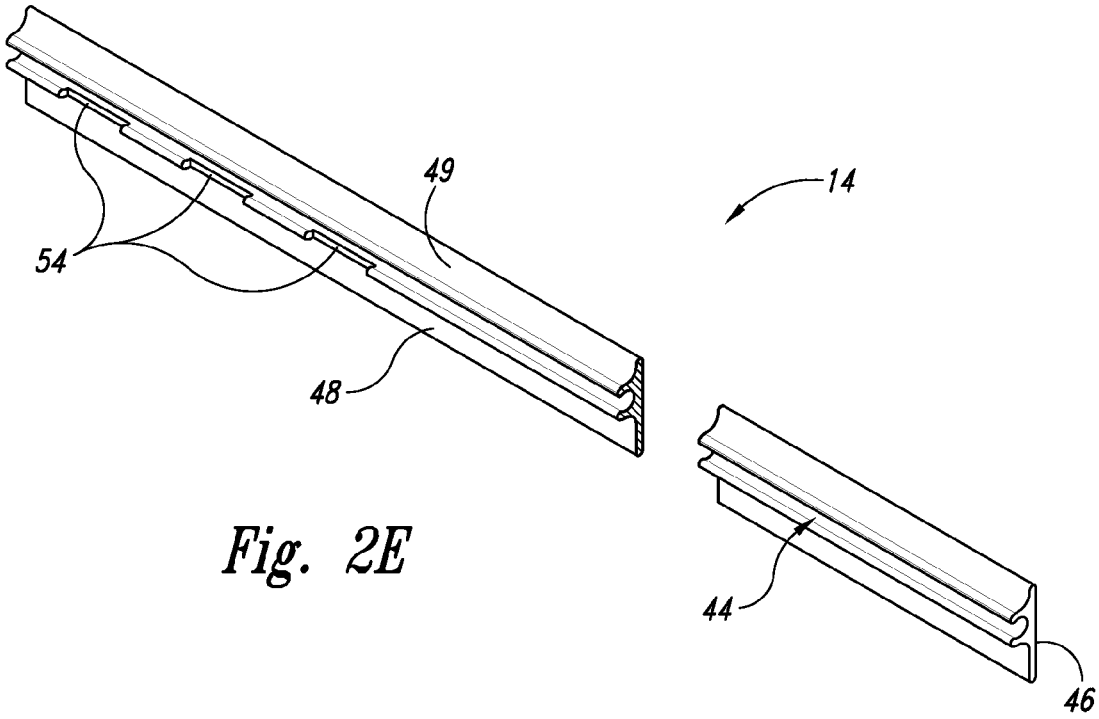
FIG. 2E is a side perspective view of the first notched rail shown in FIGS. 2A-D.
Figure 3A:
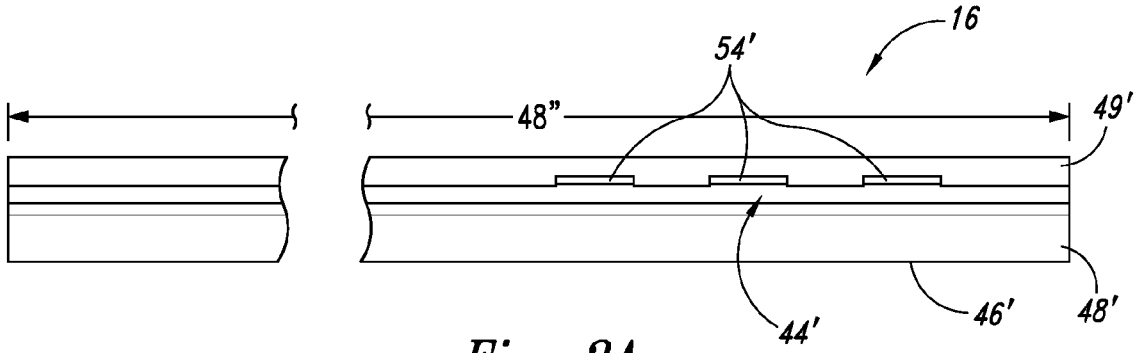
FIG. 3A is a side view of a second notched rail in accordance with an embodiment of the present invention.
Figure 3B:
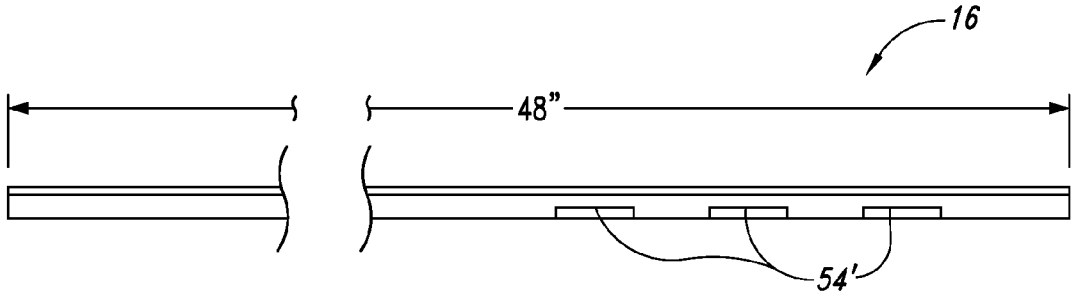
FIG. 3B is a top view of the second notched rail shown in FIG. 3A.
Figure 3C:
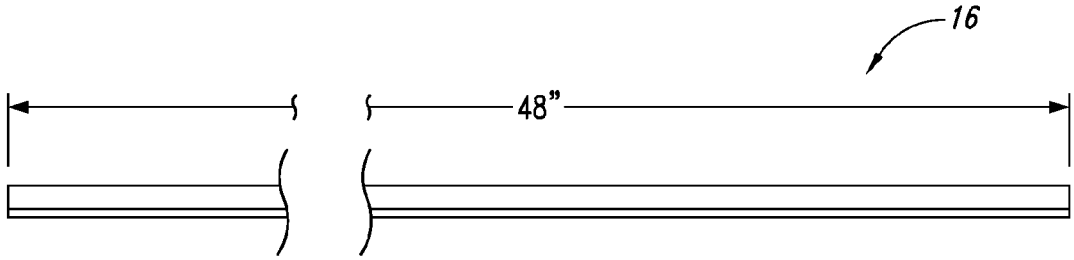
FIG. 3C is a bottom view of the second notched rail shown in FIGS. 3A-B.
Figure 3D:
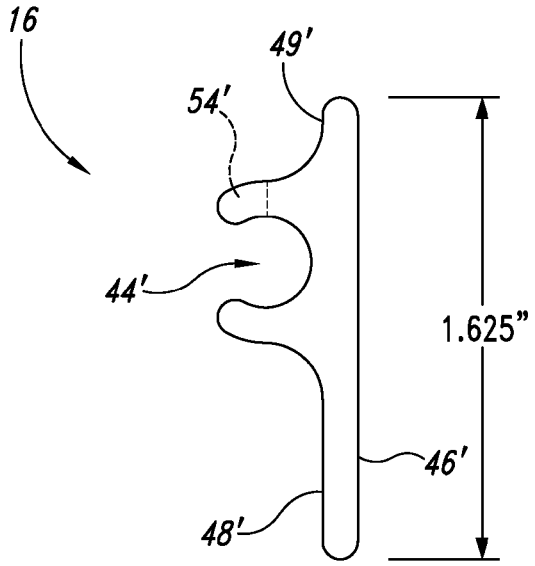
FIG. 3D is an end view of the second notched rail shown in FIGS. 3A-C.
Figure 3E:
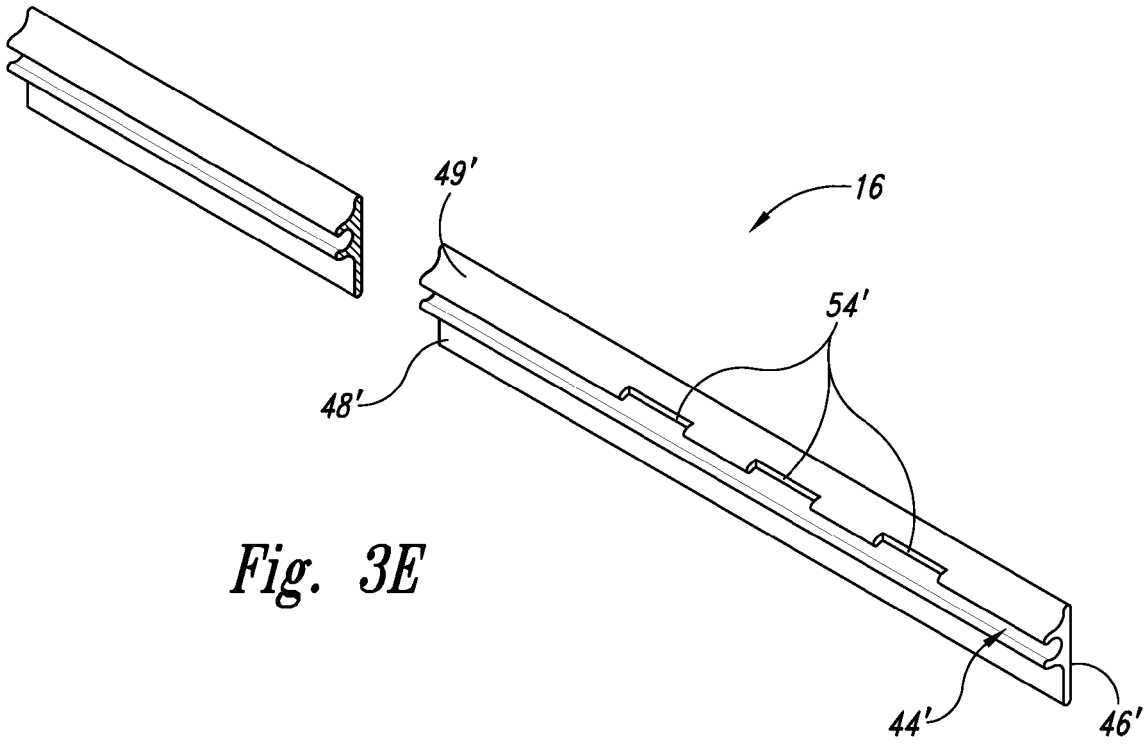
FIG. 3E is a side perspective view of the second notched rail shown in FIGS. 3A-D.
Figure 4A:
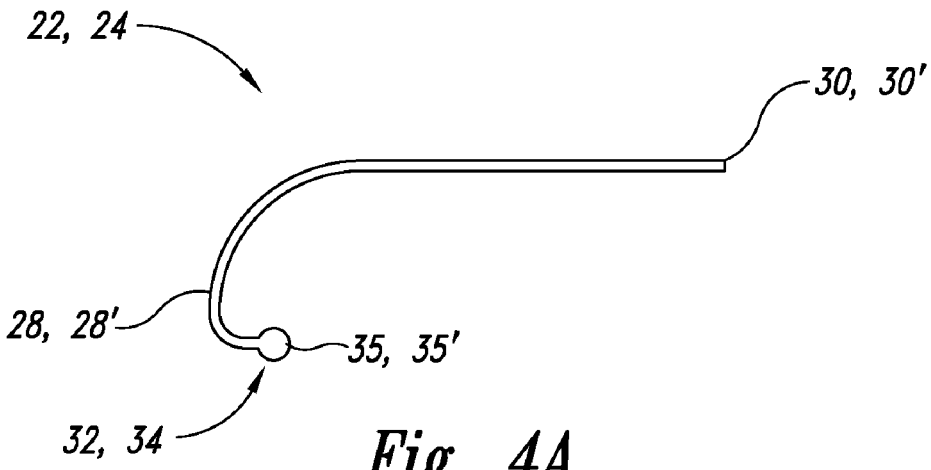
FIG. 4A is a side view of a slider in accordance with an embodiment of the present invention.
Figure 4B:
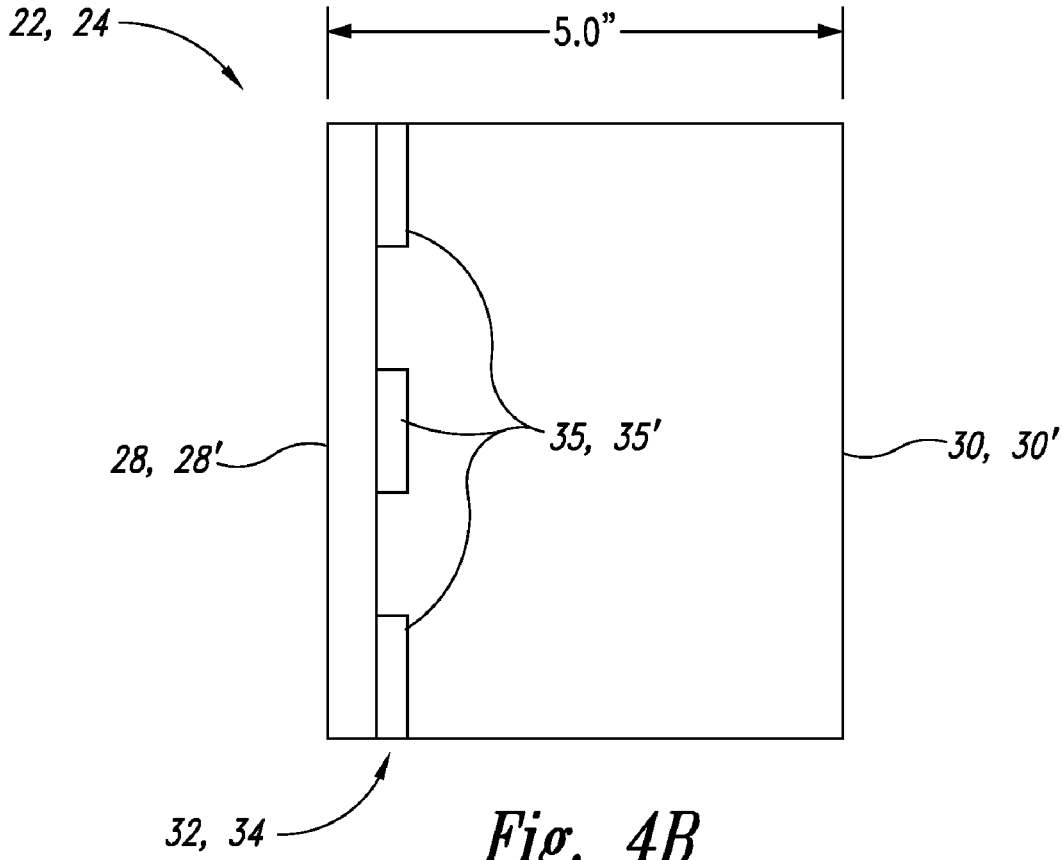
FIG. 4B is a bottom view of the slider shown in FIG. 4A.
Figure 4C:
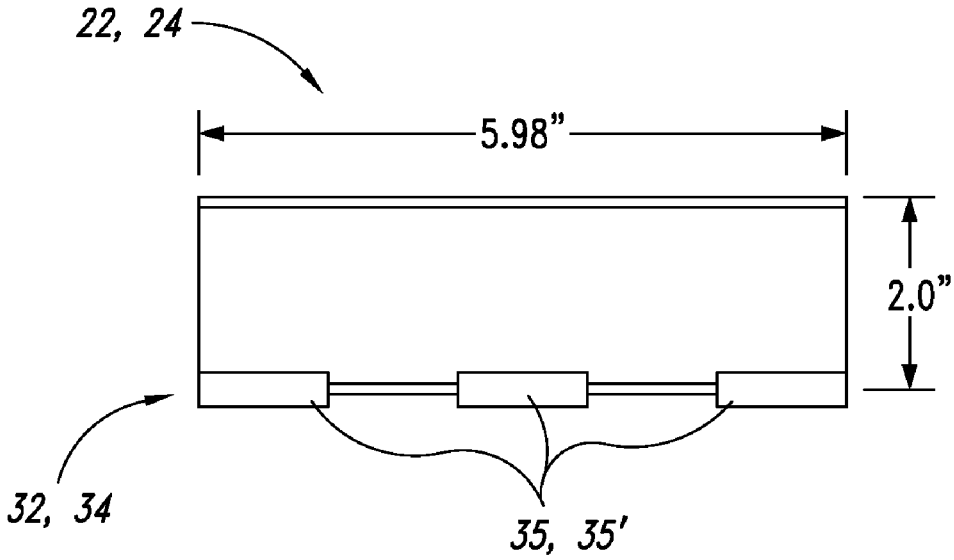
FIG. 4C is an end view of the slider shown in FIGS. 4A-B.
Figure 4D:
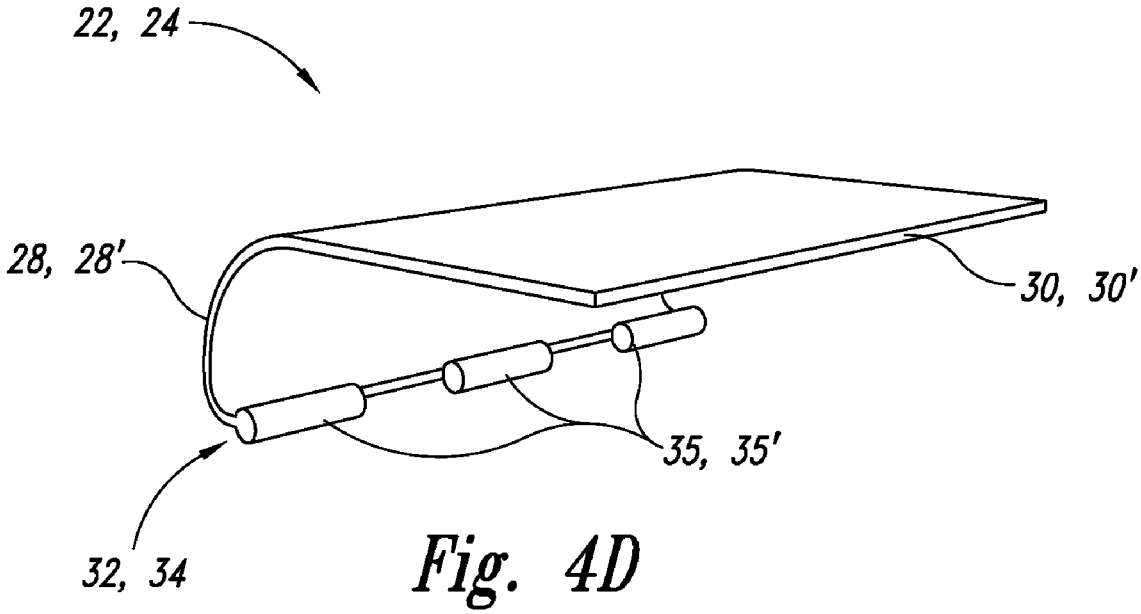
FIG. 4D is a perspective view of the slider shown in FIGS. 4A-C.
Figure 5A:
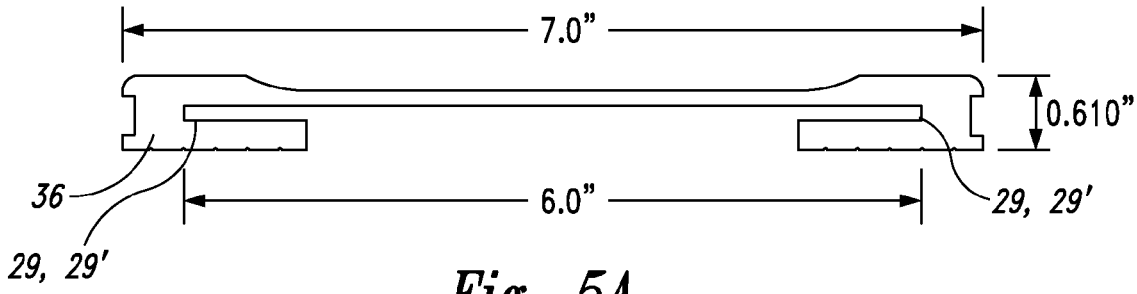
FIG. 5A is a side view of a base plate in accordance with an embodiment of the present invention.
Figure 5B:
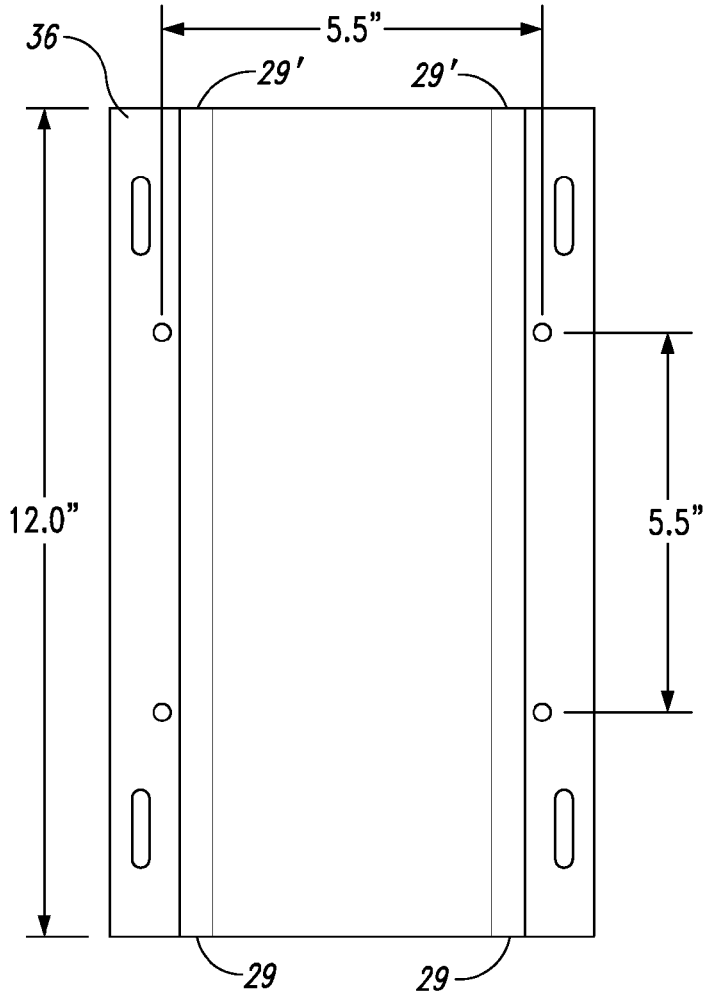
FIG. 5B is a top view of the base plate shown in FIG. 5A.
Figure 5C:
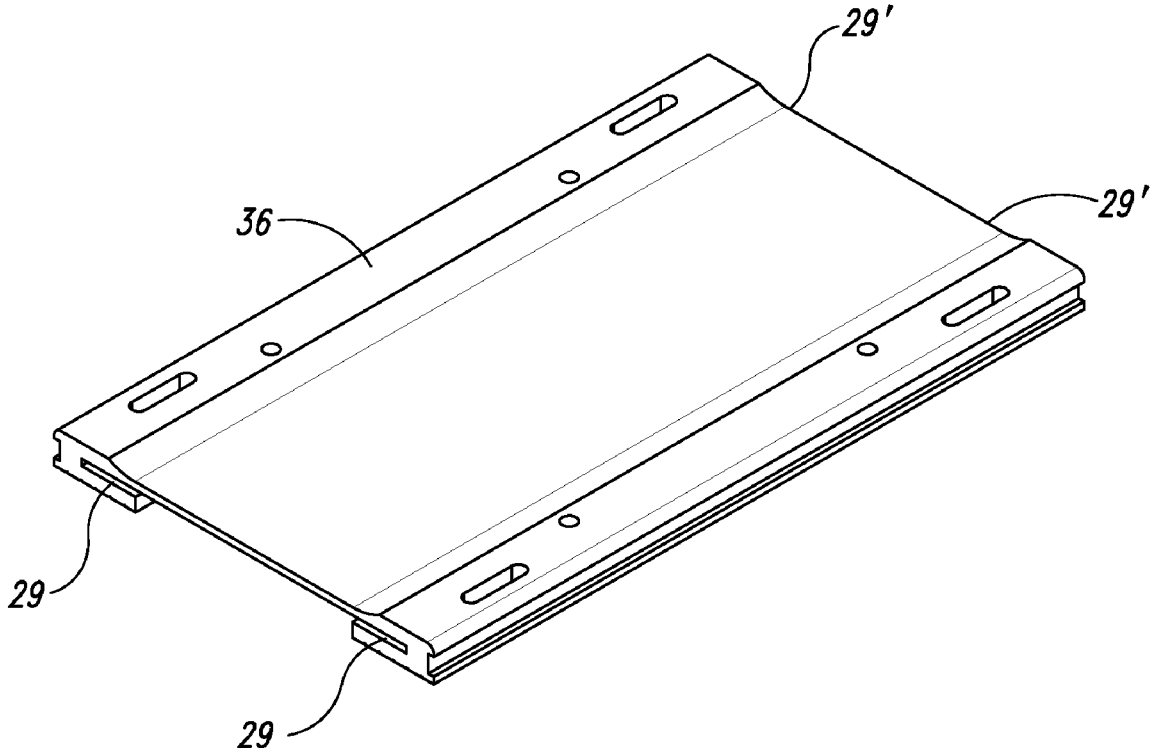
FIG. 5C is a perspective view of the base plate shown in FIGS. 5A-B.
Figure 6A:
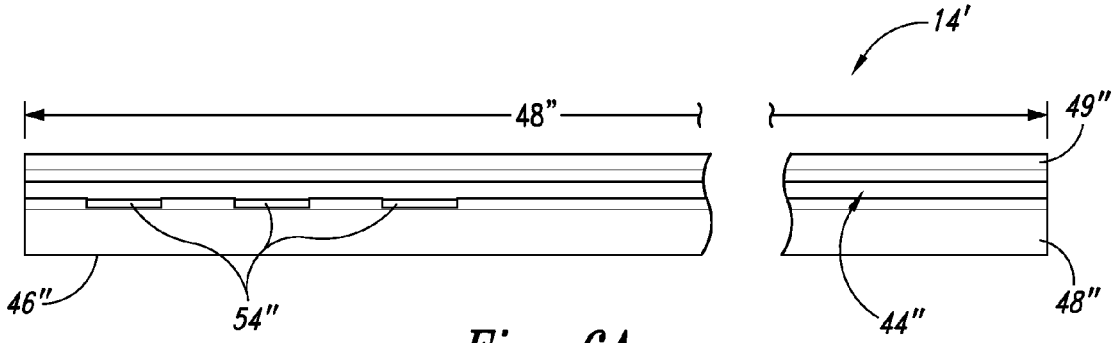
FIG. 6A is a side view of a first L-shaped notched rail in accordance with an alternative embodiment of the present invention.
Figure 6B:
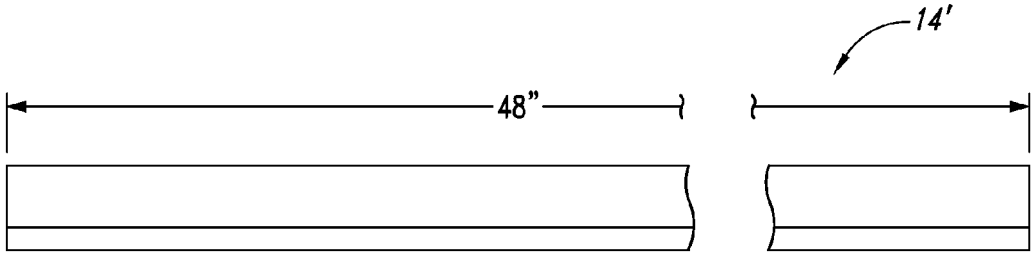
FIG. 6B is a top view of the first L-shaped notched rail shown in FIG. 6A.
Figure 6C:
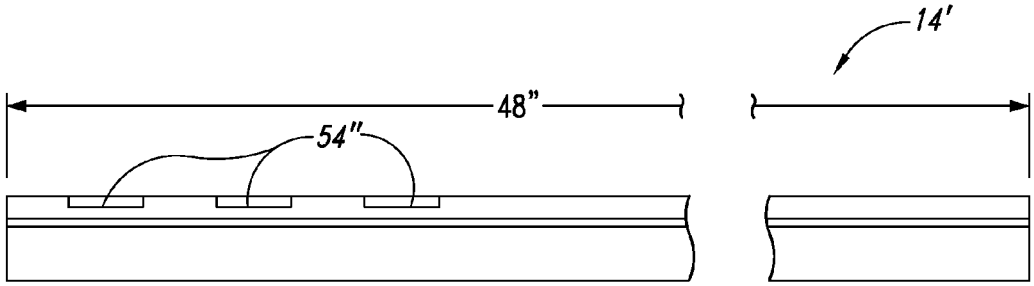
FIG. 6C is a bottom view of the first L-shaped notched rail shown in FIGS. 6A-B.
Figure 6D:
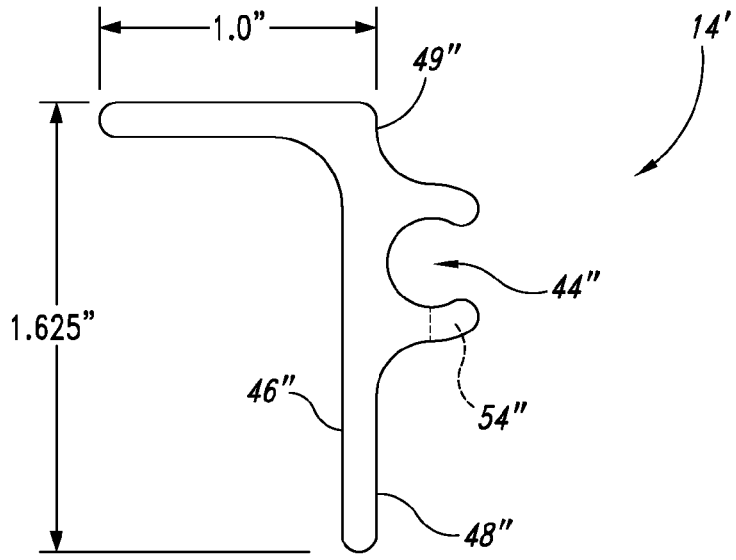
FIG. 6D is an end view of the first L-shaped notched rail shown in FIGS. 6A-C.
Figure 6E:
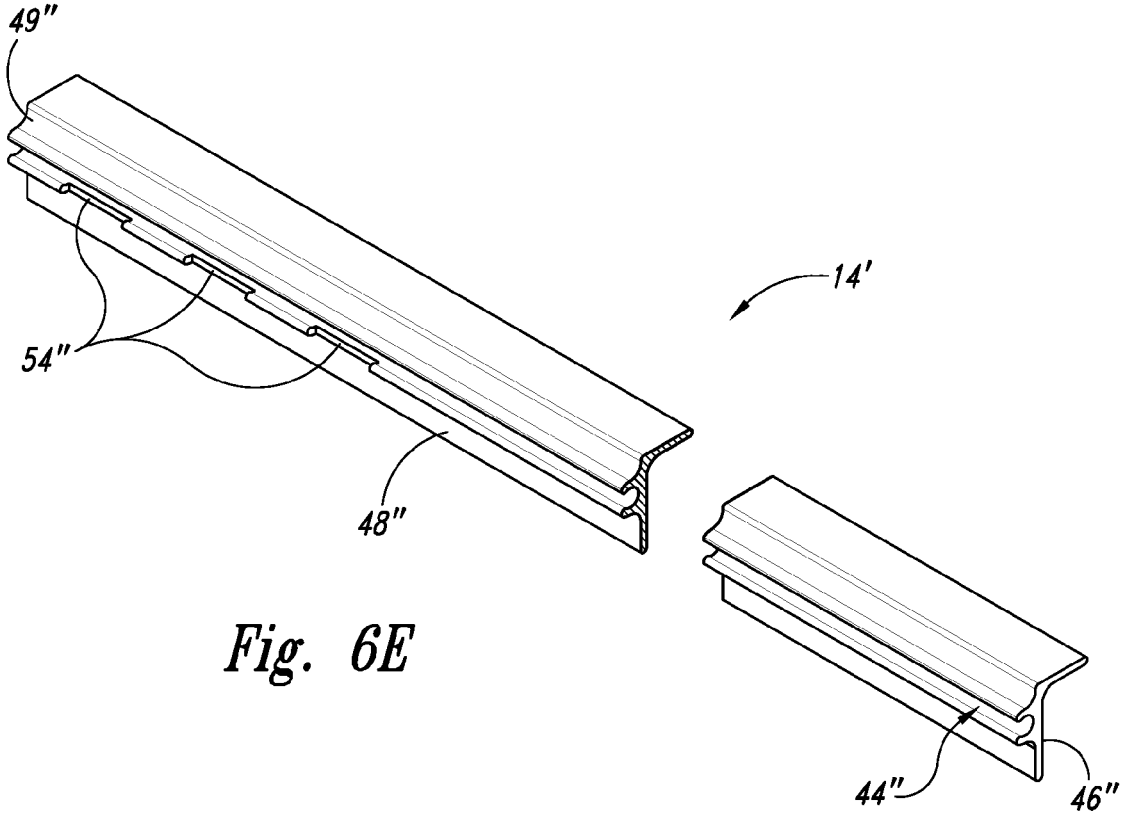
FIG. 6E is a side perspective view of the first L-shaped notched rail shown in FIGS. 6A-D.
Figure 7A:
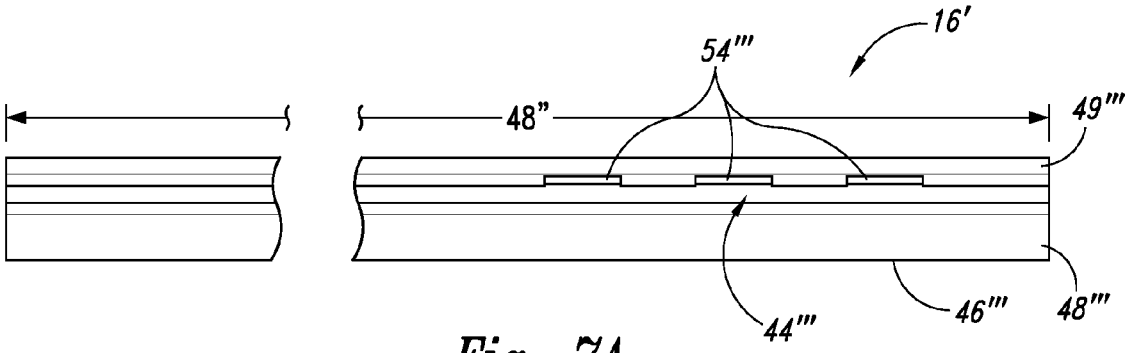
FIG. 7A is a side view of a second L-shaped notched rail in accordance with an alternative embodiment of the present invention.
Figure 7B:
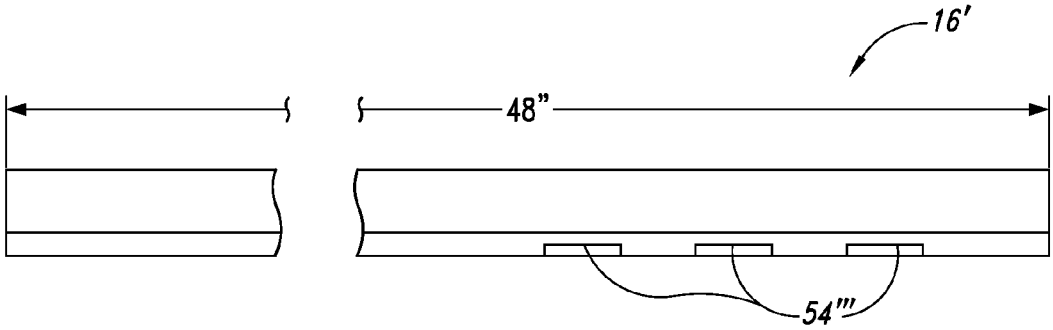
FIG. 7B is a top view of the second L-shaped notched rail shown in FIG. 7A.
Figure 7C:
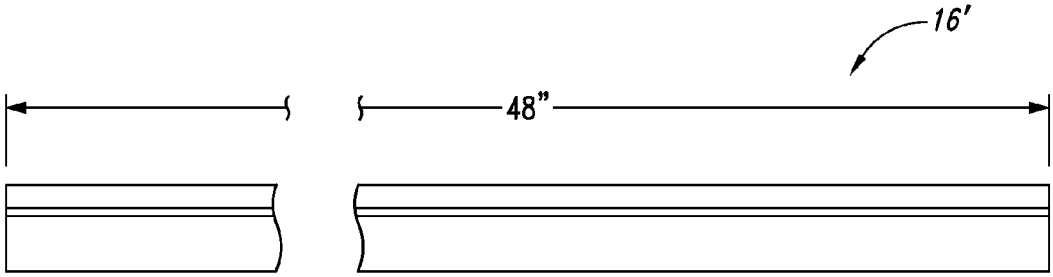
FIG. 7C is a bottom view of the second L-shaped notched rail shown in FIGS. 7A-B.
Figure 7D:
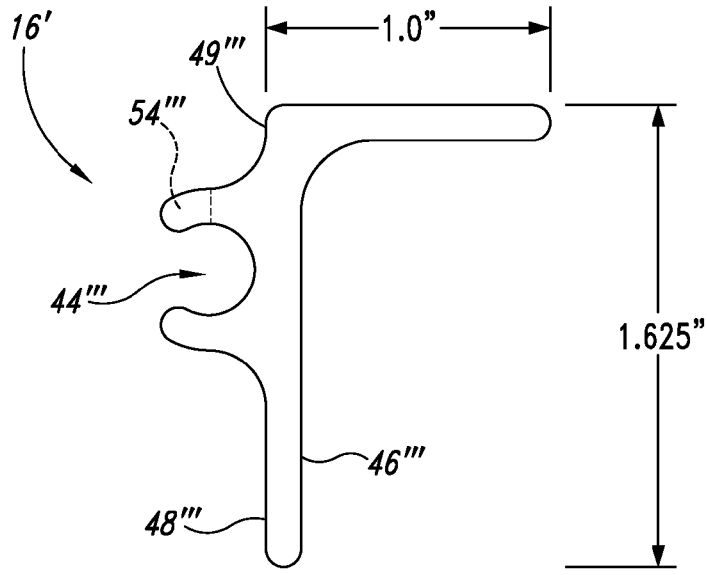
FIG. 7D is an end view of the second L-shaped notched rail shown in FIGS. 7A-C.
Figure 7E:
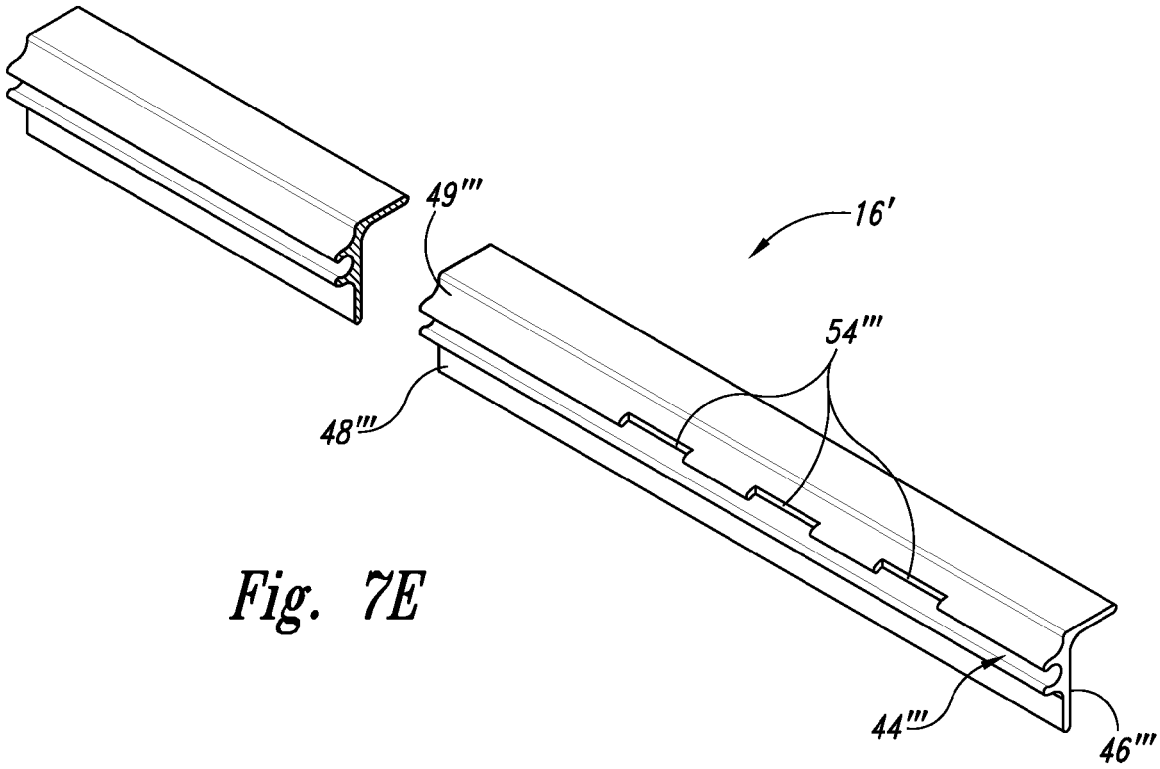
FIG. 7E is a side perspective view of the second L-shaped notched rail shown in FIGS. 7A-D.

The inventive chair mount assembly 12 also comprises an interconnecting base plate 36 (machined from aluminum, for example) positioned in the gap section 31 between the first and second sliders 22, 24. The interconnecting base plate 36 (shown in isolation in FIGS. 5A-C) is adjustably connected to the second end portions 30', 30 of the first and second sliders 24, 22 (by way of nuts and bolts and selectively positioned slotted through-holes). In other words, the interconnecting base plate 36 includes opposing receiving slots 29, 29' that retain the second end portions 30', 30 of the first and second sliders 24, 22 (and are secured in place by nut and bolt fasteners). As best shown in FIG. 1A, the interconnecting base plate 36 is moveable together with the first and second sliders 24, 22 back and forth along the first and second rails 14, 16. Finally, an optional chair 38 having a downwardly extending chair stem 40 may be mounted to the interconnecting base plate 36 (by nuts of bolts fasteners) such that the chair 38 extends outwardly away from the top surface 26 of the bench-style boat seat or thwart 12. As best shown in FIG. 1B, the chair 38 is preferably swivelable about a central axis 42 of the chair stem 40.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions, and all changes that come within the meaning and range of equivalency of the claims are to be embraced within their scope.

What is claimed is:

1. A chair mount assembly configured to retrofit a bench-style boat seat or thwart, comprising: first and second rails positioned parallel and along the lengthwise direction of respective first and second downwardly extending sidewalls of the bench-style boat seat or thwart; first and second sliders positioned across from each other and substantially above a top surface of the bench-style boat seat or thwart, each slider having respective first and second end portions, wherein the second end portions confront each other so as to define a gap section above the top surface of the bench, and wherein the first end portion of the first slider includes a first rail connector and the first end portion of the second slider includes a second rail connector, and wherein the first rail connector is matingly coupled and slidably engaged to the first rail and the second rail connector is matingly coupled and slidably engaged to the second rail; and an interconnecting base plate positioned in the gap section between the first and second sliders, wherein the interconnecting base plate is adjustably connected to the second end portions of the first and second sliders and movable together with the first and second sliders back and forth along the first and second rails, and wherein at least one of the first and second elongated rails defines an elongated raceway groove positioned on an elongated strip, wherein the elongated raceway groove is parallel to the lengthwise central axis of the bench-style boat seat or thwart and includes elongated lower and upper sidewalls, and wherein the lower and upper sidewalls define an elongated opening.

2. The chair mount assembly of claim 1 wherein the first and second elongated rails are of the same size and shape.

3. The chair mount assembly of claim 1 wherein the elongated raceway groove has a cross-sectional profile that defines a partial circle.

4. The chair mount assembly of claim 3 wherein the first and second sliders each include a downwardly curved section, wherein the downwardly curved section of the first slider includes the first rail connector and wherein the downwardly curved section of the second slider includes the second rail connector.

5. The chair mount assembly of claim 4 wherein at least one of the first and second rail connectors has a cross-sectional profile that defines a partial circle.

6. The chair mount assembly of claim 5 wherein the interconnecting base plate includes opposing receiving slots that retain the second end portions of the first and second slider.

7. The chair mount assembly of claim 1, further comprising a plurality of notches positioned along the upper sidewall of the elongated raceway groove, and wherein the first rail connector defines a plurality of complementary couplings sized and configured to pass through the plurality of notches.

8. A chair mount assembly kit for retrofitting a bench-style boat seat or thwart, comprising: first and second rails for placement along the lengthwise direction of respective first and second downwardly extending sidewalls of the bench-style boat seat or thwart; first and second sliders having respective first and second end portions, wherein the first end portion of the first slider section includes a first rail connector and the first end portion of the second slider section includes a second rail connector, and wherein the first rail connector is matingly and slidably engagable to the first rail and the second rail connector is matingly and slidably engagable to the second rail; and an interconnecting base plate that is adjustably connectable to the second end portions of the first and second sliders and movable together with the first and second sliders back and forth along the first and second rails, when the first and second rails are positioned on the respective first and second downwardly extending sidewalls, and wherein at least one of the first and second elongated rails defines an elongated raceway groove positioned on an elongated strip, wherein the elongated raceway groove is parallel to the lengthwise central axis of the bench-style boat seat or thwart and includes elongated lower and upper sidewalls, and wherein the lower and upper sidewalls define an elongated opening.

* * * * *